US007072608B2

(12) United States Patent
Takada

(10) Patent No.: US 7,072,608 B2
(45) Date of Patent: Jul. 4, 2006

(54) IMAGE FORMING APPARATUS WITH RELATIVE POSITIONING OF SUPPORT ROLLERS AND FIXING ROLLERS

(75) Inventor: Hideaki Takada, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 99 days.

(21) Appl. No.: 10/455,309

(22) Filed: Jun. 6, 2003

(65) Prior Publication Data

US 2003/0235440 A1 Dec. 25, 2003

(30) Foreign Application Priority Data

Jun. 21, 2002 (JP) ..... 2002-180675

(51) Int. Cl.
*G03G 15/16* (2006.01)

(52) U.S. Cl. ..... 399/299; 399/302

(58) Field of Classification Search ..... 399/298, 399/299, 302

See application file for complete search history.

(56) References Cited

U.S. PATENT DOCUMENTS 6,580,443 B1 6/2003 Yamaguchi et al. ..... 347/115
6,633,733 B1 * 10/2003 Mochimaru et al. ..... 399/302
6,799,011 B1 9/2004 Abe et al. ..... 399/299
2002/0051646 A1 * 5/2002 Mochimaru et al. ..... 399/45
2002/0080219 A1 6/2002 Yamaguchi et al. ..... 347/115

FOREIGN PATENT DOCUMENTS

JP 2001-117383 A 4/2001
JP 2002-144633 A 5/2002

* cited by examiner

*Primary Examiner*—William J. Royer
(74) *Attorney, Agent, or Firm*—Fitzpatrick, Cella, Harper & Scinto

(57) ABSTRACT

An image forming apparatus including a plurality of image forming portions for forming images on a plurality of image bearing members, an intermediate transfer belt in which the images on the image bearing members are transferred, a plurality of rollers around which the belt is stretched, a plurality of primary transferring portions for transferring the images to the belt at a plurality of primary transferring positions corresponding to the image bearing members, a transfer material transporting portion for transporting a transfer material, and a secondary transferring portion for transferring the images on the belt to the transported transfer material at a secondary transferring position, the primary transfer surface of the belt which is opposed to the image bearing members faces downwardly during the installation of the apparatus, and the primary transfer surface is inclined and disposed so that the secondary transferring position side oh the primary transfer surface may be downward during the installation of the apparatus.

7 Claims, 6 Drawing Sheets

IMAGE FORMING APPARATUS WITH RELATIVE POSITIONING OF SUPPORT ROLLERS AND FIXING ROLLERS

BACKGROUND OF THE INVENTION

1. Field of the Invention

The invention relates to an image forming apparatus such as a copying machine or a printer for forming an image on a recording material by the utilization of an electrophotographic process.

2. Related Art

In recent years, as a plural-color or full-color image forming apparatus of the electrophotographic type, there has been put into practical use a so-called in-line type image forming apparatus in which a plurality of photosensitive drums are arranged in a line in conformity with respective colors, and toner images of the respective colors formed on the respective photosensitive drums are successively superimposed on an intermediate transfer belt to thereby form a color image.

As an example of the conventional art, in Japanese Patent Application Laid-Open No. 2001-117383, there is described a full-color image forming apparatus (full-color printer) 101 of a conventional electrophotographic type having an in-line type intermediate transfer belt (intermediate transferring means) 120 as shown in FIG. 6 of the accompanying drawings.

This image forming apparatus 101 is provided with four image forming portions (image forming units), i.e., an image forming portion 110Y for forming a yellow image, an image forming portion 110M for forming a magenta image, an image forming portion 110C for forming a cyan image, and an image forming portion 110Bk for forming a black image, and these four image forming portions 110Y, 110M, 110C and 110Bk are arranged in a line at predetermined intervals.

In the respective image forming portions 110Y, 110M, 110C 110Bk, there are installed drum-shaped electrophotographic photosensitive members (hereinafter referred to as the photosensitive drums) 111(111Y, 111M, 111C and 111Bk) as image bearing members. Around the respective photosensitive drums, there are disposed primary chargers 112(112Y, 112M, 112C and 112Bk), developing devices 113(113Y, 113M, 113C and 113Bk), transfer rollers 115 (115Y, 115M, 115C and 115Bk) as transferring means, and drum cleaner devices 114(114Y, 114M, 114C and 114Bk), and a laser exposure device 140 is installed below the primary chargers 112 and the developing devices 113.

In the respective developing devices 113, there are contained a yellow toner, a magenta toner, a cyan toner and a black toner.

Each photosensitive drum 111 is a negatively charged OPC photosensitive member and has a photoconductive layer on a drum base made of aluminum, and is rotatively driven at a predetermined process speed in the direction of arrow (a counter-clockwise direction in FIG. 6) by a driver (not shown).

The primary chargers 112 as primary charging means uniformly charge the surfaces of the respective photosensitive drums 111 to a predetermined potential of negative polarity by a charging bias applied from a charging bias voltage source (not shown).

Each developing device 113 contains the toner therein and causes the toner of each color to adhere to an electrostatic latent image formed on each photosensitive drum 111 to thereby develop (visualize) the latent image as a toner image.

The transfer rollers 115 as primary transferring means are disposed in respective transferring portions so as to be capable of contacting with the respective photosensitive drums 111 with the intermediate transfer belt 120 interposed therebetween.

The drum cleaner devices 114 have cleaning blades or the like for removing any untransferred residual toner on the respective photosensitive drums 111 during primary transfer from the photosensitive drums 111.

The intermediate transfer belt 120 is passed over two belt conveying rollers 121 and 122, and is driven in a clockwise direction in FIG. 6. This intermediate transfer belt 120 is formed of dielectric resin such as polycarbonate, polyethylene terephthalate resin film or polyvinylidene fluoride resin film.

The secondary transfer opposed roller (conveying roller) 121 is disposed in a secondary transferring portion so as to be capable of contacting with a secondary transfer roller 130 with the intermediate transfer belt 120 interposed therebetween. Also, outside the endless intermediate transfer belt 120 and near the conveying roller 122, there is installed a belt cleaning device 123 for removing and collecting any untransferred toners remaining on the surface of the intermediate transfer belt 120. Also, a fixing device 103 having a fixing roller 103*a* and a pressure roller 103*b* is installed downstream of and above the secondary transferring portion with respect to the transport direction of a transfer material P and forms a substantially vertical transport path.

The exposure device 140 is comprised of laser beam emitting means for effecting beam emission corresponding to the time-serial electrical digital pixel signal of given image information, a polygon lens, a reflecting mirror, and the like, and exposes each photosensitive drum 111 to the laser beam to thereby form an electrostatic latent image for each color conforming to the image information on the surface of each photosensitive drum 111 charged by each primary charger 112.

By the above-described construction, the toner images formed on the surfaces of the respective photosensitive drums 111 are successively primary-transferred onto the intermediate transfer belt 120, whereby a color image is formed thereon, and this color image is secondary-transferred to the transfer material P transported from a cassette 102, by the secondary transfer roller 130 whereafter it is fixed on the transfer material P by the fixing device 103, and the transfer material P is delivered onto a delivery tray 101*a* outside the image forming apparatus 101 by delivery rollers 128.

As described above, in the construction as shown in FIG. 6 wherein the fixing device 103 is disposed above the secondary transferring portion and the transfer material P is delivered onto the delivery tray 101*a* on the upper surface of the main body of the image forming apparatus 101 with the recording surface thereof facing down, the transport path is short and an improvement in throughput can be achieved and the transport path concentrates in one location, and this leads to the feature that jam clearance is easy to do.

In the above-described conventional image forming apparatus 101, however, the total height of the apparatus main body is determined by the height of the feed cassette 102, the exposure device 140, the photosensitive drums 111 and the intermediate transfer belt 120 as they are stacked one upon another, the distance from the secondary transferring portion to the fixing device 103, and the height from the fixing device 103 to the delivery rollers 128 as a delivery portion, and it has been difficult to make the height of the apparatus main body small.

Particularly, in the transport path of the transfer material P between the secondary transferring portion and the fixing device 103, in the secondary transferring portion, in order to accurately transfer the toner image on the intermediate transfer belt 120 to the transfer material P, and in the fixing device 103, in order to fix the toner image on the transfer material P by heat and pressure, in order that in both of them, the nipping force may be strong and the transfer material P may be transported without slipping, it is sometimes practiced to set the transport speed in the fixing device 103 so as not to be low relative to the transport speed in the secondary transferring portion, and transport the transfer material P while being slowed down between the secondary transferring portion and the fixing device 103. For this purpose, the distance between the secondary transferring portion and the fixing device 103 is determined in conformity with the length and stiffness of the transfer material P and therefore, it has been difficult to simply lower the position of the fixing device 103.

Also, in recent years, the compactness, space saving and lower cost of the product are required, and it has been one of the most important items to make the size of the apparatus main body small.

In Japanese Patent Application Laid-Open No. 2002-144633, there is described a construction in which an intermediate transfer belt passed over two rollers is inclined with its secondary transferring position facing down. However, this is a construction in which a primary transferring surface is disposed upwardly and as a result, the distance from the secondary transferring position to a transfer material delivery portion becomes long, and a reduction in throughput is caused and jam clearance becomes difficult.

SUMMARY OF THE INVENTION

So, it is the object of the present invention to provide an image forming apparatus of which the height of the main body can be made small and the downsized design can be achieved.

An image forming apparatus for achieving the above object has:

a plurality of image forming means for forming images on a plurality of image bearing members;

an intermediate transfer belt to which the images on the plurality of image bearing members are transferred;

a plurality of rollers over which the intermediate transfer belt is stretched;

a plurality of primary transferring means for transferring the images to the intermediate transfer belt at a plurality of primary transferring positions corresponding to the plurality of image bearing members;

transfer material transporting means for transporting a transfer material; and secondary transferring means for transferring the images on the intermediate transfer belt to the transfer material being transported at a secondary transferring position, wherein the primary transfer surface of the intermediate transfer belt formed on a side opposed to the plurality of image bearing members is inclined and disposed so that the primary transfer surface may face downwardly during the installation of the image forming apparatus and the secondary transferring position side on the primary transfer surface may be downward during the installation of the image forming apparatus.

DETAILED DESCRIPTION OF THE PREFERRED EMBODIMENTS

An embodiment of the present invention will hereinafter be described with reference to the drawings.

Figure 1:
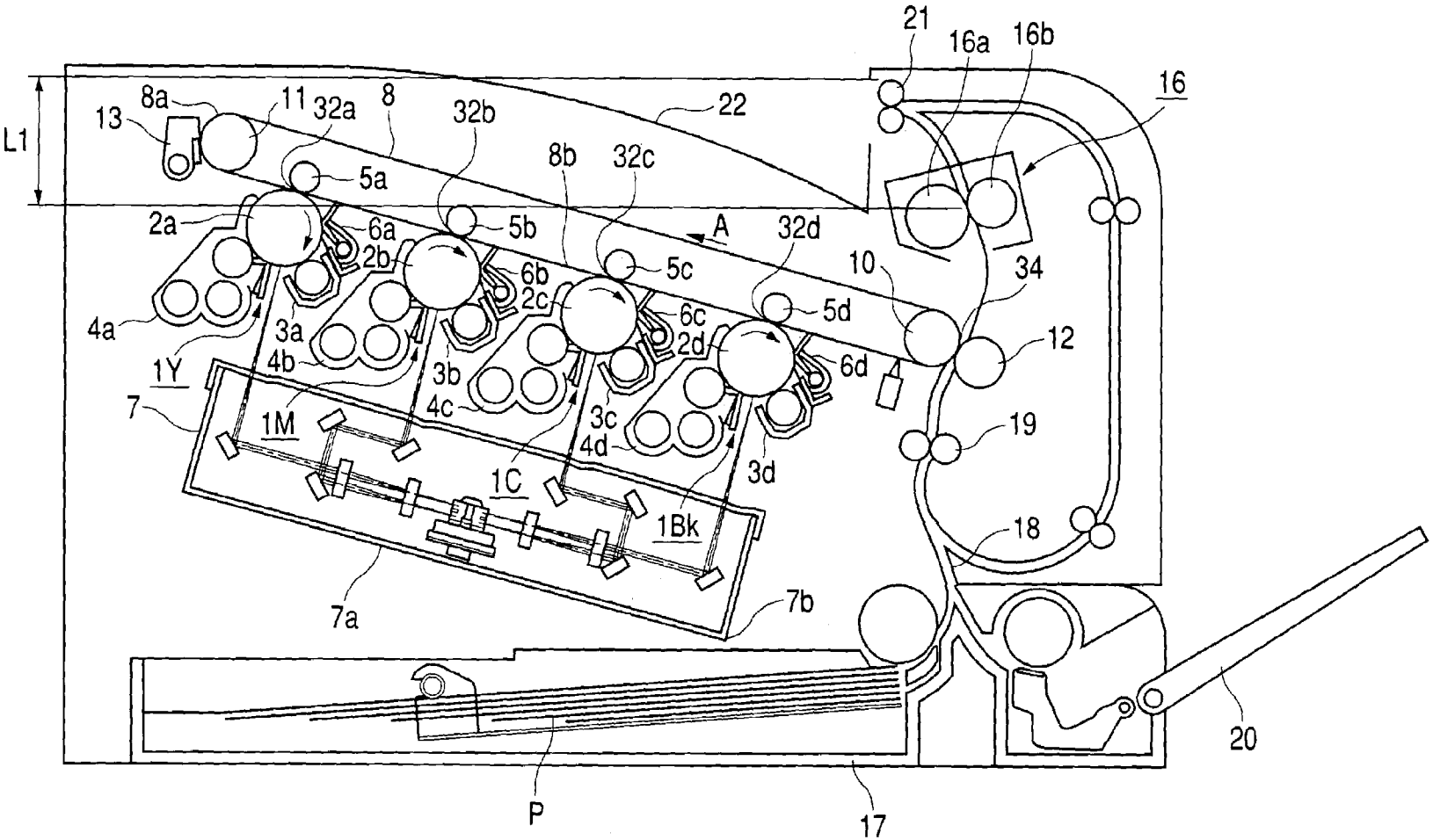
FIG. 1 is a side cross-sectional view of a full-color printer as an image forming apparatus to which the present invention is applied.

FIG. 1 schematically shows the construction of an in-line type full-color image forming apparatus (full-color printer) of the electrophotographic type of the present invention having an intermediate transfer belt (intermediate transferring means).

This image forming apparatus is provided with four image forming portions (image forming units), i.e., an image forming portion 1Y for forming a yellow image, an image forming portion 1M for forming a magenta image, an image forming portion 1C for forming a cyan image, and an image forming portion 1Bk for forming a black image, and these image forming portions 1Y, 1M, 1C and 1Bk are arranged in a line at predetermined intervals.

Drum-shaped electrophotographic photosensitive drums (hereinafter referred to as the photosensitive drums) 2*a*, 2*b*, 2*c* and 2*d* as image bearing members are installed in the respective image forming portions 1Y, 1M, 1C and 1Bk. Around the respective photosensitive drums 2*a*, 2*b*, 2*c* and 2*d*, there are disposed primary chargers 3*a*, 3*b*, 3*c* and 3*d*, developing devices 4*a*, 4*b*, 4*c* and 4*d*, transfer rollers 5*a*, 5*b*, 5*c* and 5*d* as transferring means, and drum cleaner devices 6*a*, 6*b*, 6*c* and 6*d*, and a laser exposure device 7 is installed below the primary chargers 3*a*, 3*b*, 3*c* and 3*d* and the developing devices 4*a*, 4*b*, 4*c* and 4*d*.

A yellow toner, a magenta toner, a cyan toner and a black toner are contained in the respective developing devices 4*a*, 4*b*, 4*c* and 4*d*.

Each of the photosensitive drums 2*a*, 2*b*, 2*c* and 2*d* is a negatively charged OPC photosensitive member and has a photoconductive layer on a drum base made of aluminum, and is rotatively driven at a predetermined process speed in the direction of arrow (a clockwise direction in FIG. 1) by a driver (not shown).

The primary chargers 3*a*, 3*b*, 3*c* and 3*d* as primary charging means uniformly charge the surfaces of the respective photosensitive drums 2*a*, 2*b*, 2*c* and 2*d* to a predetermined potential of negative polarity by a charging bias applied from a charging bias voltage source (not shown).

The developing devices 4*a*, 4*b*, 4*c* and 4*d* contain the toners therein, and cause the toners of respective colors to adhere to electrostatic latent images formed on the respective photosensitive drums 2*a*, 2*b*, 2*c* and 2*d* to thereby develop (visualize) the latent images as toner images.

The transfer rollers 5*a*, 5*b*, 5*c* and 5*d* as primary transferring means are disposed in respective primary transferring portions 32*a*, 32*b*, 32*c* and 32*d* so as to be capable of contacting with the respective photosensitive drums 2*a*, 2*b*, 2*c* and 2*d* with an intermediate transfer belt 8 interposed therebetween.

The drum cleaner devices 6*a*, 6*b*, 6*c* and 6*d* have cleaning blades or the like for removing any untransferred residual toners on the photosensitive drums 2 (2*a*, 2*b*, 2*c* and 2*d*) during primary transfer from the photosensitive drums 2.

The intermediate transfer belt 8 is stretched around a secondary transfer opposed roller 10 and a tension roller 11, and is driven in the direction of arrow A (a counter-clockwise direction in FIG. 1) by the secondary transfer opposed roller 10 acting as a driving roller. This intermediate transfer belt 8 is formed of dielectric resin such as polycarbonate, polyethylene terephthalate resin film or polyvinylidene fluoride resin film.

The secondary transfer opposed roller 10 is disposed in a secondary transferring portion 34 so as to be capable of contacting with a secondary transfer roller 12 with the intermediate transfer belt 8 interposed therebetween. Also, outside the endless intermediate transfer belt 8 and near the tension roller 11, there is installed a belt cleaning device 13 for removing and collecting any untransferred toners remaining on the surface of the intermediate transfer belt 8. Also, downstream of and above the secondary transferring portion 34 with respect to the transport direction of a transfer material P, a fixing device 16 having a fixing roller 16*a* and a pressure roller 16*b* is installed and forms a substantially vertical transport path.

The exposure device 7 is comprised of laser beam emitting means for effecting beam emission corresponding to the time-serial electrical digital pixel signal of given image information, a polygon lens, a reflecting mirror, and the like, and exposes the photosensitive drums 2*a*, 2*b*, 2*c* and 2*d* to light to thereby form electrostatic latent images for the respective colors conforming to the image information on the surfaces of the respective photosensitive drums 2*a*, 2*b*, 2*c* and 2*d* charged by the respective primary chargers 3*a*, 3*b*, 3*c* and 3*d*.

Description will now be made of the image forming operation of the above-described image forming apparatus.

When an image formation starting signal is generated, the photosensitive drums 2*a*, 2*b*, 2*c* and 2*d* of the respective image forming portions 1Y, 1M, 1C and 1Bk rotatively driven at a predetermined process speed are uniformly charged to the negative polarity by the primary chargers 3*a*, 3*b*, 3*c* and 3*d*, respectively. Then, the exposure device 7 applies from a laser beam emitting element color-separated image signals inputted from the outside, to thereby form electrostatic latent images for the respective colors on the respective photosensitive drums 2*a*, 2*b*, 2*c* and 2*d* via the polygon lens, the reflecting mirror, and the like.

The yellow toner is first caused to adhere to the electrostatic latent image formed on the photosensitive drum 2*a* by the developing device 4*a* to which a developing bias of the same polarity as the charging polarity (the negative polarity) of the photosensitive drum 2*a* has been applied to thereby visualize the latent image as a toner image. This yellow toner image is primary-transferred onto the driven intermediate transfer belt 8 by the transfer roller 5*a* to which a primary transfer bias (a polarity (positive polarity) opposite to that of the toners) has been applied, in the primary transferring portion 32*a* between the photosensitive drum 2*a* and the transfer roller 5*a*.

The intermediate transfer belt 8 onto which the yellow toner image has been transferred is moved to the image forming portion 1M side. Again in the image forming portion 1M, in the same manner as previously described, a magenta toner image formed on the photosensitive drum 2*b* is superimposed on the yellow toner image on the intermediate transfer belt 8 and is transferred thereonto in the primary transferring portion 32*b*.

At this time, any untransferred residual toner on the respective photosensitive drums 2 is scraped off and collected by the cleaning blades or the like provided in the drum cleaner devices 6*a*, 6*b*, 6*c* and 6*d*.

Thereafter, in the same manner, a cyan toner image and a black toner image are formed on the photosensitive drums 2*c* and 2*d*, respectively of the image forming portions 1C and 1Bk are successively superimposed on the yellow and magenta toner images superimposed and transferred onto the intermediate transfer belt 8 in the respective primary transferring portions 32*a*–32*d* to thereby form a full-color toner image on the intermediate transfer belt 8.

In timed relationship with the movement of the leading edge of the full-color toner image on the intermediate transfer belt 8 to the secondary transferring portion 34 between the secondary transfer opposed roller 10 and the secondary transfer roller 12, a transfer material (paper) P selected from a feed cassette 17 or a manual feed tray 20 and fed through a transport path 18 is transported to the secondary transferring portion 34 by registration rollers 19. The full-color toner image is collectively secondary-transferred to the transfer material P transported to the secondary transferring portion 34, by the secondary transfer roller 12 to which a secondary transferring bias (a polarity (positive polarity) opposite to that of the toners) has been applied.

The transfer material P on which the full-color toner image has been formed is transported to the fixing device 16, and the full-color toner image is heated and pressurized in a fixing nip portion between the fixing roller 16*a* and the pressure roller 16*b* and is heat-fixed on the surface of the transfer material P, where after the transfer material P is delivered onto a delivery tray 22 on the upper surface of the main body of the image forming apparatus by delivery rollers 21, thus terminating a series of image forming operations. Any secondary-untransferred toners or the like remaining on the intermediate transfer belt 8 are removed and collected by the belt cleaning device 13.

In the present embodiment, the intermediate transfer belt 8 is characterized in that the primary transfer surface (8*b*) thereof formed on the side thereof opposed to the photosensitive drums 2*a*, 2*b*, 2*c* and 2*d* is inclinedly disposed with the secondary transfer roller side thereof facing downwardly.

That is, in FIG. 1, the intermediate transfer belt 8 has its primary transfer surface, i.e., its lower flat surface 8*b* which is movably disposed in opposed relationship with the upper surfaces of the photosensitive drums 2*a*, 2*b*, 2*c* and 2*d* and formed on the side opposed to the photosensitive drums 2, inclinedly disposed so that the secondary transferring portion 34 side may be downward. Specifically, this angle of inclination is set to about 150 with respect to a horizontal direction. Also, the intermediate transfer belt 8 is stretched around two rollers, i.e., the secondary transfer opposed roller 10 disposed the secondary transferring portion side and imparting a driving force to the intermediate transfer belt 8, and the tension roller 11 disposed on the opposed side with the primary transferring portions 32*a*–32*d* interposed therebetween and imparting tension to the intermediate transfer belt 8.

Also, the intermediate transfer belt 8 has its uppermost surface 8*a* which is determined by the disposed position of the tension roller 11 disposed at a position higher than the nipping portion of the fixing device 16 (the nip portion between the fixing roller 16*a* and the pressure roller 16*b*) and lower than the delivery rollers 21 which are delivery means (the range of L1 in FIG. 1). By such disposition, it becomes possible to effectively utilize the space above the intermediate transfer belt 8, and yet minimize the height of the main body of the image forming apparatus.

The secondary transfer opposed roller 10 serves also as a driving roller for the intermediate transfer belt 8 by a driving force being transmitted thereto from the driving means, not shown, of the main body of the image forming apparatus through a coupling or the like. The function of the driving roller is thus also given to the secondary transfer opposed roller 10, whereby it becomes possible to decrease the number of rollers necessary to stretch the intermediate transfer belt 8 and reduce the manufacturing cost, and also contribute to space saving.

Also in the present embodiment, the lower belt surface (primary transfer surface) 8*b* of the intermediate transfer belt 8 is inclinedly disposed and therefore, the image forming portions 1Y, 1M, 1C and 1Bk including the photosensitive drums 2*a*–2*d* contacting with the lower belt surface 8*b* are also inclinedly disposed, and the exposure device 7 is likewise inclinedly disposed.

The lower belt surface (primary transfer surface) 8*b* of the intermediate transfer belt 8 below which the image forming portions 1Y, 1M, 1C and 1Bk are disposed is inclinedly disposed with the secondary transferring portion side facing downwardly, whereby adjacent ones of the image forming portions 1Y, 1M, 1C and 1Bk are such that the image forming portion located on the downstream side (on the right side as viewed in FIG. 1) of the intermediate transfer belt 8 with respect to the transport direction is disposed more below. At the same time, the intermediate transfer belt 8 is also inclinedly disposed and thus, a large space is formed above the upper surfaces of the developing devices 4 (4*a*, 4*b*, 4*c* and 4*d*) provided in the image forming portions disposed below.

As a result, the primary chargers 3 (3*a*, 3*b*, 3*c* and 3*d*) and the drum cleaner devices 6 (6*a*, 6*b*, 6*c* and 6*d*) provided in the image forming portions located on the upstream side of and above the intermediate transfer belt 8 with respect to the transport direction are disposed on the upper surfaces of the developing device 4 (4*a*, 4*b*, 4*c* and 4*d*) of the image forming portions adjacent to the downstream side, whereby it becomes possible to make them proximate to the more downstream image forming portions, and the interval between adjacent ones of the image forming portions (the distance between adjacent ones of the photosensitive drums) can be made shorter. Thereby, a reduction in cost by shortening the circumferential length of the intermediate transfer belt 8 can be achieved, and also it becomes possible to make the size of the main body of the image forming apparatus in the arrangement direction of the image forming portions (the horizontal direction in FIG. 1) small.

Figure 2:
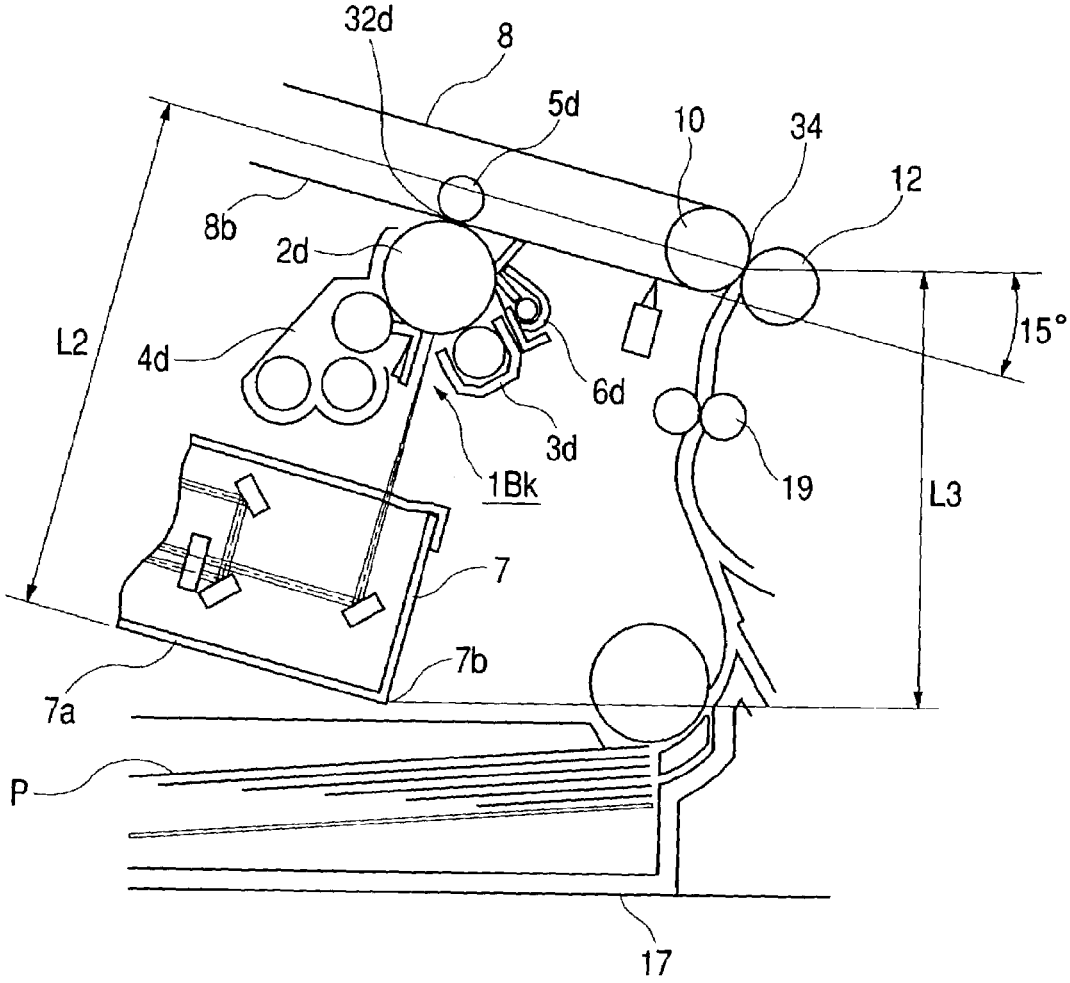
FIG. 2 is a side cross-sectional view of the essential portions of the image forming apparatus to which the present invention is applied.

Now, as shown in FIG. 2, the distance L2 from the underside 7*a* of the exposure device 7 to the secondary transferring portion 34 is substantially determined by the height dimension of the exposure device 7, the diameter of the photosensitive drums 2*a*–2*d* and the radius of the secondary transfer opposed roller 10.

However, the lower end portion 7*b* of the inclinedly disposed exposure device 7 which is adjacent to the secondary transferring portion 34 is located on the primary transferring portion 32*d* side relative to a vertical line passing through the secondary transferring portion 34 and therefore, the lower belt surface (primary transfer surface) 8*b* of the intermediate transfer belt 8 is inclinedly disposed with the secondary transferring portion 34 side facing downwardly, whereby the lower end portion 7*b* of the exposure device 7 is moved to the upward side.

Thereby, the vertical distance L3 between the secondary transferring portion 34 and the lower end portion 7*b* can be made shorter than the distance L2 from the underside 7*a* of the exposure device 7 to the secondary transferring portion 34, i.e., the distance L2 along a direction substantially orthogonal to the lower belt surface (primary transfer surface) 8*b*. Therefore, as a result, the distance between the feed cassette 17 and the secondary transferring portion 34 can be made short and the feed cassette 17 can be disposed more closely to the secondary transferring portion 34 side and consequently, the height of the main body of the image forming apparatus can be made small.

Also, for example, the drum cleaner device 6*a* and the primary charger 3*a* provided in the image forming portion 1Y on the upstream side of the intermediate transfer belt 8 with respect to the transport direction are disposed above the developing device 4*b* of the image forming portion 1M located adjacent to the downstream side with respect to the transport direction, whereby the interval between adjacent ones of the image forming portions 1Y, 1M, 1C and 1Bk can be narrowed and the circumferential length of the intermediate transfer belt 8 can be shortened. This relationship also holds true between the image forming portion 1M and the image forming portion 1C, and between the image forming portion 1C and the image forming portion 1Bk. Thus, it becomes possible to achieve the downsizing of the main body of the image forming apparatus in the arrangement direction of the image forming portions 1Y, 1M, 1C and 1Bk, and manufacture the image forming apparatus at low costs.

Further, in the present embodiment, the uppermost surface 8*a* of the intermediate transfer belt 8 is disposed at a position higher than the nipping portion (heating and pressurizing portion) of the fixing device 16 and lower than the delivery rollers 21 which are delivery means, whereby both of the height on the fixing device side and the height on the intermediate transfer belt side are well balanced. Thereby, the height of the main body of the image forming apparatus can be made small, and also the angle of inclination of the lower belt surface (primary transfer surface) 8*b* of the intermediate transfer belt 8 can be set to a great angle.

Further, in the present embodiment, toner containers 30*a*, 30*b*, 30*c* and 30*d* (FIG. 3) for supplying the toners to the developing devices 4*a*, 4*b*, 4*c* and 4*d*, respectively, are disposed laterally of the intermediate transfer belt 8 as viewed in a plan view.

Figure 3:
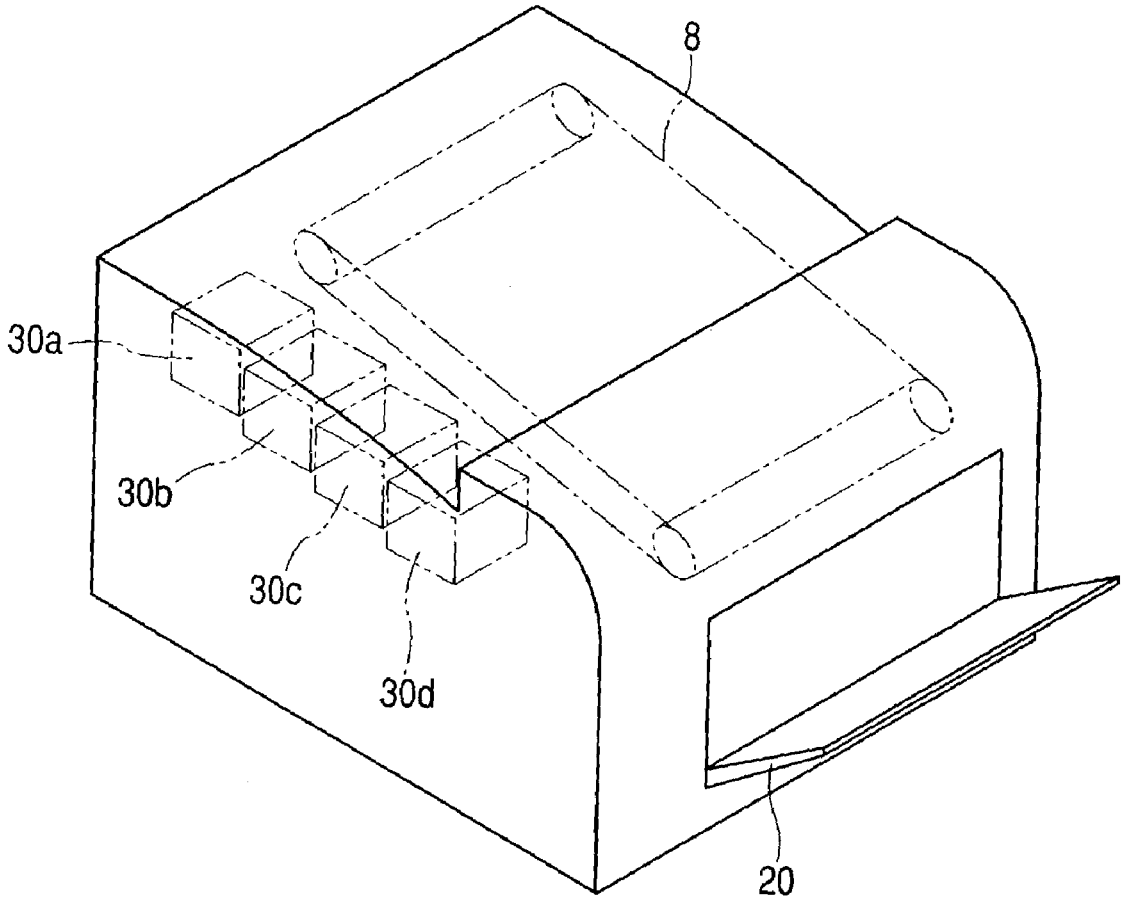
FIG. 3 is a pictorial perspective view of the image forming apparatus.
Figure 4:
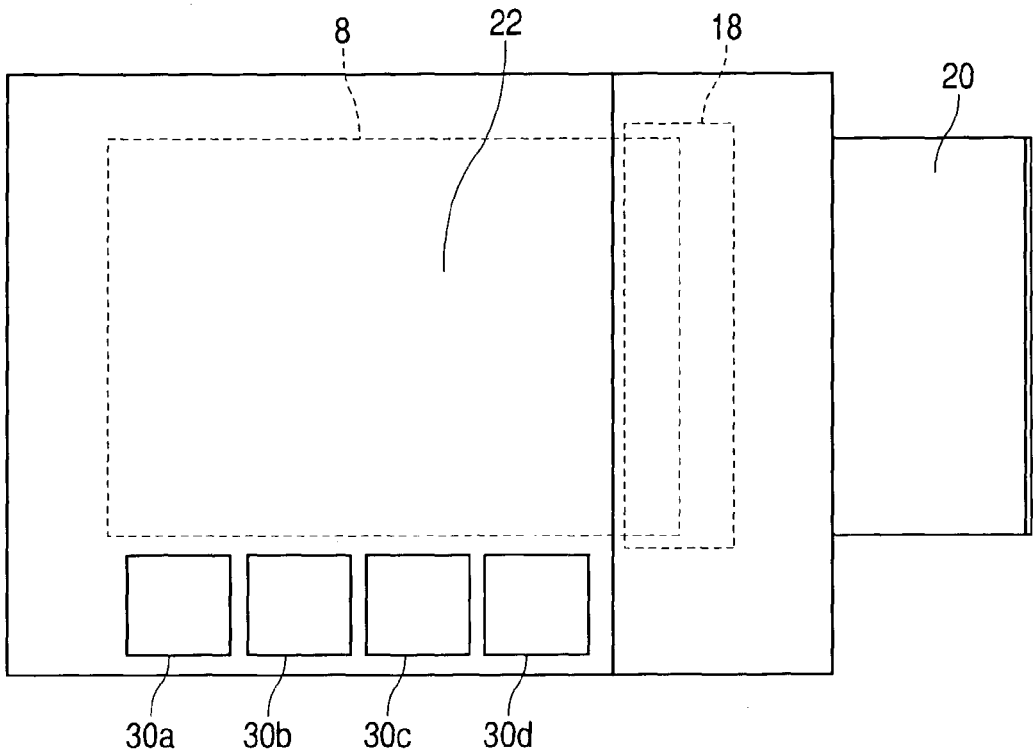
FIG. 4 is a plan view of the image forming apparatus.
Figure 5:
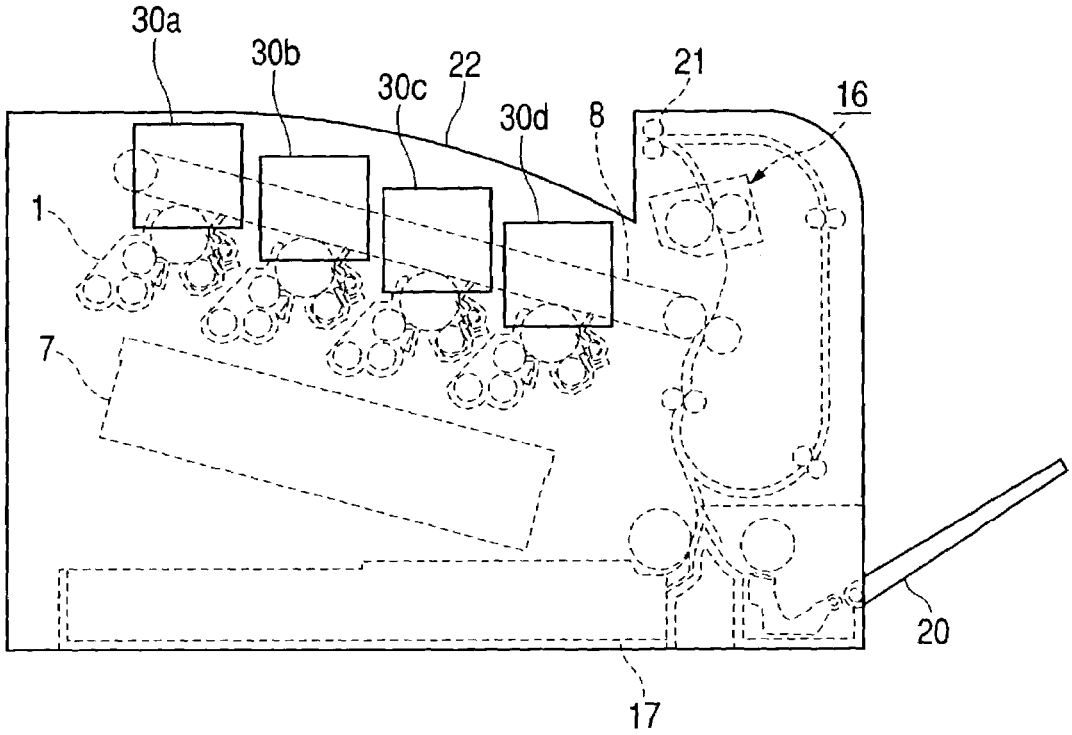
FIG. 5 is a side view of the image forming apparatus.
Figure 6:
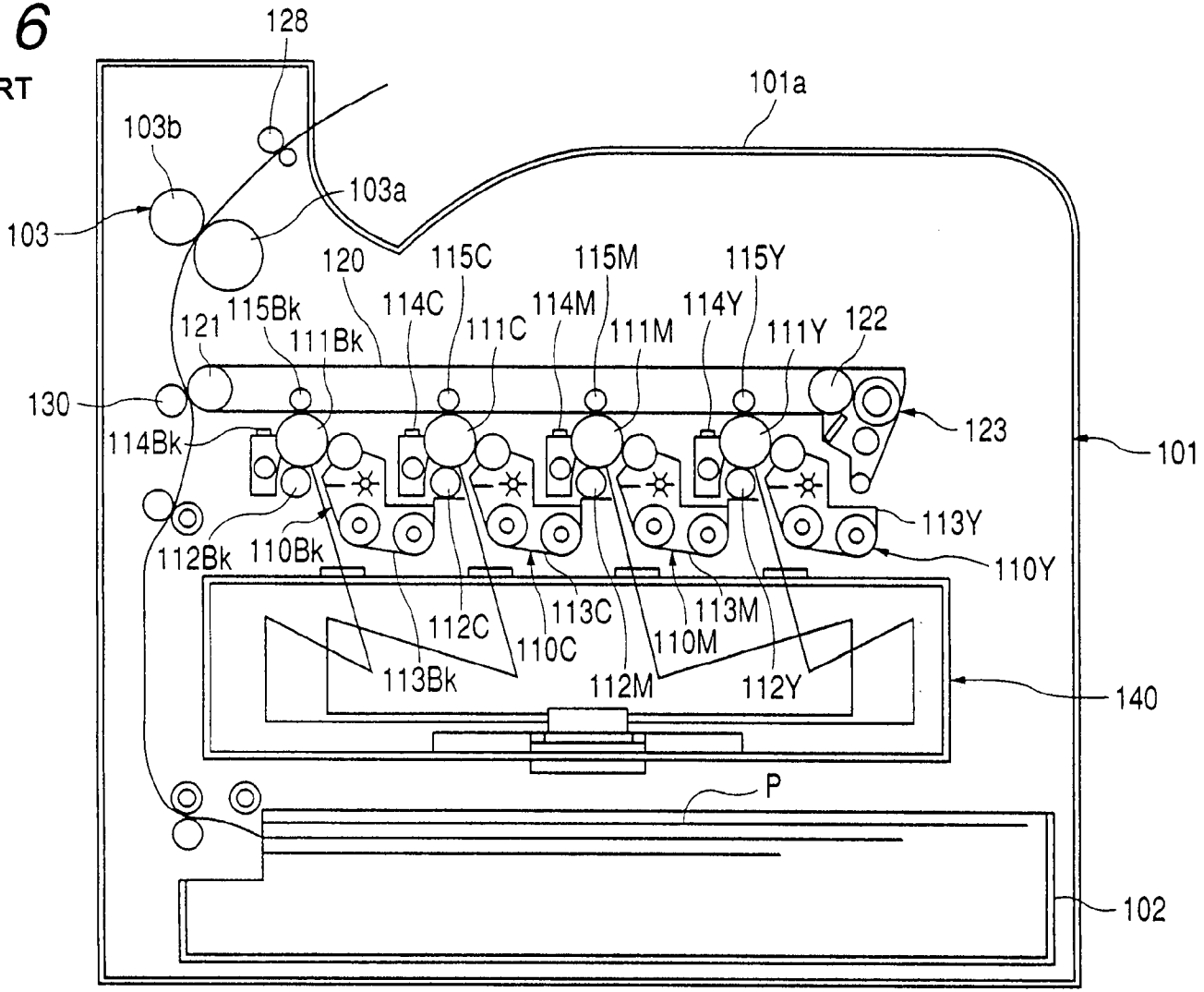
FIG. 6 PRIOR ART
FIG. 6 is a side cross-sectional view of a conventional image forming apparatus.

As shown in FIGS. 3 to 5, the toners consumed in the respective image forming portions 1Y, 1M, 1C and 1B*k* are contained in the toner containers 30*a*, 30*b*, 30*c* and 30*d*, respectively, disposed laterally of the intermediate transfer belt 8 and the image forming portions 1Y, 1M, 1C and 1Bk, and the toners are carried to the developing devices 4 (4*a*, 4*b*, 4*c* and 4*d*) of the image forming portions 1Y, 1M, 1C and 1B*k* by toner supplying means, not shown.

These toner containers 30*a*–30*d* can be interchanged as required to thereby supply the toners, and these toner containers 30*a*–30*d* are not disposed above the intermediate transfer belt 8 and therefore affect little the height of the main body of the image forming apparatus. These toner containers 30*a*–30*d* are disposed on a side of the upper surface portion of the main body which forms the delivery tray 22 and thus, they are disposed with such a high degree of freedom that during the designing of the main body of the image forming apparatus, any of the interchange thereof from the upper surface and the interchange thereof from the side can be selected in conformity with the specification or the like of the image forming apparatus.

According to the present embodiment, the toner containers 30 (30*a*, 30*b*, 30*c* and 30*d*) containing therein the toners formed on the photosensitive drums 2*a*–2*d* are disposed sideways of the intermediate transfer belt 8, whereby it becomes possible to make the height of the main body of the image forming apparatus small, and it is possible to provide an image forming apparatus excellent in the interchangeability of the toner containers 30.

The image forming portions 1Y, 1M, 1C and 1Bk are disposed in the order of the image forming portion 1Y for image forming by the yellow toner, the image forming portion 1M for image forming by the magenta toner, the image forming portion 1C for image forming by the cyan toner, and the image forming portion 1Bk for image forming by the black toner so as to be parallel to the inclined lower belt surface (primary transfer surface) 8*b* of the intermediate transfer belt 8 and so that the yellow image forming portion 1Y may be uppermost and the black image forming portion 1B*k* may be lowermost.

While in the above-described embodiment, the rollers for stretching the intermediate transfer belt 8 have been described as being constituted by two rollers, i.e., the secondary transfer opposed roller 10 serving also as a driving roller, and the tension roller 11, three or more rollers may be used so as to take partial charge of the role as required.

Also, while in FIG. 1, the right side of the figure has been described as the front of the main body of the image forming apparatus, the front direction may be set to any direction, and may be this side or the inner part side in FIG. 1, and a similar effect can be obtained irrespective of the front direction of the main body of the image forming apparatus.

Also, while in the above-described embodiment, the cross section of the exposure device 7 is of a rectangular shape, it also becomes possible to make the height of the main body still smaller by chamfering a corner which is a lower end portion 7*b* within a range free of influence upon parts disposed in the exposure device 7, upwardly moving the position of the lower end portion 7*b*, and shortening the vertical distance L3 between the secondary transferring portion 34 and the lower end portion 7*b*.

Further, while in the present embodiment, the angle of inclination of the lower belt surface 8*b* (primary transfer surface) of the intermediate transfer belt 8 is 15°, this angle is not restrictive, but other angles of inclination can be selected as required in conformity with the height of the fixing device 16, the size of the exposure device 7, and the like.

What is claimed is:

1. An image forming apparatus comprising:

a plurality of image forming means for forming toner images;

a rotatable intermediate transfer belt having a surface, to which the toner images are primarily transferred, said surface being declined and facing downward opposite to said plurality of image forming means;

a plurality of rollers for supporting said intermediate transfer belt;

a plurality of primary transferring means for primarily transferring the toner images to said intermediate transfer belt in a plurality of primary transfer positions;

secondary transferring means for secondarily transferring the toner images from said intermediate transfer belt to a recording material in a secondary transfer position;

fixing means including a pair of fixing members contacting with each other in a contact portion for fixing the toner images, which are secondarily transferred to the recording material in the secondary transfer position, to the recording material; and delivery means for delivering the recording material, to which the toner images are fixed, to a position that is outside of said image forming apparatus, wherein an uppermost roller among said plurality of rollers is disposed above the contact portion of said pair of fixing members and below an uppermost portion of said delivery means, and wherein an angle formed by said surface with a horizontal plane is smaller than an angle formed by said surface with a vertical plane.

2. An image forming apparatus according to claim 1, wherein the secondary transfer position is nearer to a lowermost portion of said surface than an uppermost portion of said surface.

3. An image forming apparatus according to claim 2, wherein said plurality of rollers are two rollers.

4. An image forming apparatus comprising:

a plurality of image forming means having at least developing means using developer for forming toner images;

a plurality of toner containers for containing the developer to be supplied to said developing means;

a rotatable intermediate transfer belt having a surface, to which the toner images are primarily transferred, said surface being declined with facing downward opposite to said plurality of image forming means;

a plurality of rollers for supporting said intermediate transfer belt;

a plurality of primary transferring means for primarily transferring the toner images to said intermediate transfer belt in a plurality of primary transfer positions;

secondary transferring means for secondarily transferring the toner images from said intermediate transfer belt to a recording material in a secondary transfer position; and fixing means including a pair of fixing members contacting with each other in a contact portion for fixing the toner images, which are secondarily transferred to the recording material in the secondary transfer position, to the recording material, wherein an angle formed by said surface with a horizontal plane is smaller than an angle formed by said surface with a vertical plane, and wherein said plurality of toner containers are disposed to a position, which is outside a project area of said intermediate transfer belt projected from a position, which is vertically above of said image forming apparatus, onto a bottom surface of said image forming apparatus.

5. An image forming apparatus according to claim 4, further comprising delivery means for delivering the recording material, to which the toner images are fixed, to a position that is outside of said image forming apparatus, wherein an uppermost roller among said plurality of rollers is disposed to a position, which is above the contact portion of said pair of fixing members and below an uppermost portion of said delivery means.

6. An image forming apparatus according to claim 5, wherein the secondary transfer position is nearer to a lowermost portion of said surface than an uppermost portion of said surface.

7. An image forming apparatus according to claim 6, wherein said plurality of rollers are two rollers.

* * * * *

UNITED STATES PATENT AND TRADEMARK OFFICE

CERTIFICATE OF CORRECTION

PATENT NO. : 7,072,608 B2
APPLICATION NO. : 10/455309
DATED : July 4, 2006
INVENTOR(S) : Hideaki Takada It is certified that error appears in the above-identified patent and that said Letters Patent is hereby corrected as shown below:

TITLE PAGE AT ITEM [57] ABSTRACT:
Line 17, “oh” should read --on--.

COLUMN 10:
Line 49, “of” should be deleted.
Line 65, “are” should read --is--.

Signed and Sealed this

Thirteenth Day of March, 2007

JON W. DUDAS
*Director of the United States Patent and Trademark Office*